United States Patent [19]

Papay et al.

[11] 4,178,258

[45] Dec. 11, 1979

[54] LUBRICATING OIL COMPOSITION

[75] Inventors: Andrew G. Papay, Manchester; Edward F. Zaweski, St. Louis, both of Mo.

[73] Assignee: Edwin Cooper, Inc., St. Louis, Mo.

[21] Appl. No.: 907,159

[22] Filed: May 18, 1978

[51] Int. Cl.[2] ..... C10M 1/48; C10M 1/38

[52] U.S. Cl. ..... 252/32.7 E; 252/33.6

[58] Field of Search ..... 252/32.7 E, 33.6

[56] References Cited

U.S. PATENT DOCUMENTS

| | | | |
|---|---|---|---|
| 3,030,303 | 4/1962 | Ryan | 252/33.6 |
| 3,244,627 | 4/1966 | Smith et al. | 252/33.6 |
| 3,248,325 | 4/1966 | Graham | 252/33.6 |
| 3,915,871 | 10/1975 | Bryer et al. | 252/33.6 |

*Primary Examiner*—Irving Vaughn

*Attorney, Agent, or Firm*—Donald L. Johnson; Robert A. Linn; Joseph D. Odenweller

[57] ABSTRACT

Lubricating oil adapted for use in spark ignited and diesel engines containing an antiwear amount of a molybdenum bis(dialkyldithiocarbamate).

13 Claims, No Drawings

LUBRICATING OIL COMPOSITION

BACKGROUND OF THE INVENTION

Several molybdenum compounds have been used as lubricating oil additives. For example, molybdenum disulfide in dispersed form is an effective lubricating oil additive. Another compound which has been used is molybdenumdioxy dialkyldithiocarbamate described in U.S. Pat. No. 3,419,589. Several molybdenum dialkyldithiophosphate complexes are described in U.S. Pat. Nos. 3,068,259; 3,400,140 and 3,402,188.

Diesel engines are well known for their long endurance under most severe conditions. Because of this they have found favor for use in heavy duty trucks and locomotives. Although diesel engines have seen limited use in light duty automotive application, it is only recently that such use has begun to increase sharply. This is due to industry attempts to achieve increased fuel economy. In general, these light duty automotive diesel engines are not as heavily constructed as prior heavy duty engines and less expensive metals and metal alloys are used. This has brought about a wear problem in light duty automotive diesel engines that was not of such significance in heavy duty engines.

The wear problem appears to be due mainly to blow-by carbon soot which accumulates in the crankcase. This soot either causes wear or serves to negate the effect of additives such as zinc dihydrocarbyldithiophosphates which are customarily added to inhibit wear. In fact, in tests it has been found that zinc dihydrocarbyldithiophosphates, rather than acting as a wear inhibitor, can, in the presence of carbon soot, cause an increase in wear.

SUMMARY OF THE INVENTION

It has now been found that molybdenum bis(dialkyldithiocarbamates) can significantly improve the friction properties and the wear characteristics of lubricating oil. It is especially effective in lubricating oil containing a zinc dihydrocarbyldithiophosphate. This is especially beneficial when the oil is used in the crankcase of a diesel engine in which environment the oil becomes contaminated with blow-by carbon soot.

DESCRIPTION OF THE PREFERRED EMBODIMENTS

A preferred embodiment of the invention is a lubricating oil containing an antioxidant amount of an oil soluble zinc dihydrocarbyldithiophosphate (ZDDP) and a wear inhibiting amount of an oil soluble molybdenum bis(dialkyldithiocarbamate).

The alkyl groups in the dialkyldithiocarbamate should be of sufficient size to render the compound oil soluble. They need not both be the same alkyl group. A useful range of alkyls contain from about 4–20 carbon atoms. Examples of these are the Mo (II) salts of isobutyl-n-dodecyl-dithiocarbamic acid, isobutyl-n-decyl dithiocarbamic acid, di-n-hexyl dithiocarbamic acid, 2-ethylhexyl-n-hexadecyl dithiocarbamic acid, di-n-dodecyl dithiocarbamic acid, 2-ethylbutyl-n-isoeicosyl dithiocarbamic acid, isobutyl-sec-eicosyl dithiocarbamic acid and di-n-tetradecyl dithiocarbamic acid.

More preferably, the alkyl groups contain 6–18 carbon atoms. Examples of these are molybdenum bis(dialkyl dithiocarbamates) in which the dithiocarbamate radical is one of the following: di-n-hexyl dithiocarbamate, n-hexyl-n-dodecyl dithiocarbamate, di-n-octyl dithiocarbamate, di-2-ethyloctyl dithiocarbamate, 2-ethylhexyl-n-octadecyl dithiocarbamate, and di-2-ethyldecyl dithiocarbamate.

Especially preferred additives are molybdenum bis[-di(2-ethylhexyl)dithiocarbamate] and molybdenum bis(-di-n-dodecyl dithiocarbamate).

The molydbenum bis dialkyldithiocarbamates can be readily made by reacting a dialkyl amine with carbon disulfide and an alkali metal base to form an alkali metal dialkyl dithiocarbamate which is then reacted with $MoCl_2$. This reaction is described in U.S. Pat. No. 2,258,847. The following examples serve to illustrate the preparation of the molybdenum additive.

EXAMPLE 1

In a reaction vessel was placed 600 ml 95% ethanol, 21.2 gms (0.06 mol) of di-n-dodecyl amine, 4.8 gms (0.063 mol) of carbon disulfide and 5.5 gms (0.066 mol) of $NaHCO_3$. To this solution was added 5 gms (0.03 mol) of $MoCl_2$. A deep green solution resulted. This was refluxed overnight. Some solids had formed. The mixture was cooled to room temperature and extracted with heptane. The heptane solution was washed with water and filtered. The heptane solution was then evaporated under vacuum leaving 23.5 gms of molybdenum bis(di-n-dodecyldithiocarbamate) as a dark green waxy solid which analyzed: Mo 9.99 wt %, S 11.1 wt %, and N 2.58 wt %.

EXAMPLE 2

In a reaction vessel was placed 144.9 gms (0.6 mol) of di(2-ethylhexyl)amine, 360 ml of 95% methanol, 48 gms (0.63 mol) of carbon disulfide, 54 gms (0.66 mol) of sodium acetate and 46.1 gms (0.28 mol) of $MoCl_2$. The mixture was refluxed for 20 hours. The solution was then extracted with heptane and filtered. The heptane solution was water washed and then evaporated under vacuum at 85° C. yielding 215.5 gms of molybdenum bis[di(2-ethylhexyl)dithiocarbamate] in the form of a black liquid.

Other additives can be made in accordance with the above examples by substituting other dialkyl amine. For example, use of di-n-octadecyl amine forms molybdenum bis (di-n-octadecyl-dithiocarbamate).

The ZDDP additives are conventionally made by reacting phosphorus pentasulfide with the desired alkanol (e.g. isobutanol, pentanol, 2-ethylbutanol and the like) or phenol (e.g. p-nonylphenol) to form O,O-dihydrocarbyldithio-phosphoric acid and then neutralizing this acid with zinc oxide. Such additives are items of commerce.

The amount of ZDDP used in the lubricating oil formulations should be enough to provide the desired antioxidant protection. This concentration is conventionally expressed in terms of weight percent zinc in the lubricating oil. A useful range is 0.005–0.5 wt % zinc. A preferred range is 0.01–0.25 wt % zinc.

The amount of molybdenum bis(dialkyldithiocarbamate) used should be an amount which will restore the wear inhibiting property of ZDDP or at least an amount that will inhibit the pro-wear effect of ZDDP in the presence of carbon soot. A useful range is about 0.05–3 wt % based on the formulated oil. A preferred range is 0.1–1.0 wt %.

The oil used is preferably a mineral oil or a blend of mineral oil with a synthetic hydrocarbon oil such as α-olefin oligomer (e.g. α-decene trimer) or an alkylbenzene, although other synthetic oils such as the synthetic ester oils (e.g. dinonyladipate or trimethylpropane tripelargonate) can be used.

Other additives may be used in formulating the oil such as barium or calcium alkylphenates, sulfurized calcium phenates, phosphorosulfurized polyolefin, barium salts of phosphorosulfurized polyisobutylene, calcium petroleum sulfonates, dispersants such as the polyisobutylene succinimide of tetraethylenepentamine, Mannich condensation products of polyisobutylphenol-formaldehyde-tetraethylenepentamine and similar boronated Mannichs, phenolic antioxidants such as 4,4'-methylenebis(2,6-di-tert-butylphenol), polymethacrylate and ethylene propylene copolymer VI improvers and the like.

The lubricating oil compositions are most useful in the crankcase of diesel engines. Diesel engines introduce carbon soot into the crankcase through piston blow-up. Tests have shown that in the presence of carbon soot ZDDP can act to increase wear rather than to reduce wear. The tests carried out were standard 4-ball wear tests in which one steel ball was rotated under load against three fixed balls in a pyramid arrangement. The balls were immersed in a mineral lubricating oil at 93° C. containing the test additives. Applied load was 15 kg and rotation was at 1,800 rpm for 30 minutes. Wear was determined by measuring the diameter of the scar on the fixed balls. A larger scar diameter means more wear.

The oil used in the tests was a mineral oil (2.5 cs 99° C.) containing 2 wt % of a commercial succinimide dispersant and 2 wt % lampblack. Tests were conducted both with and without a commercial ZDDP (concentration to provide 0.15 wt % Zn). Results were as follows:

| Additive | Conc (wt %) | Scar Diameter (mm) Without ZDDP | With ZDDP |
|---|---|---|---|
| None[1] | — | — | 0.27 |
| None[2] | — | 0.43 | 0.64 |
| Example 1 | 1% | 0.52 | 0.31 |
| Example 2 | 1% | — | 0.30 |

[1]No test additive and no lampblack
[2]With 2 wt % lampblack

The test oil without lampblack, dispersant or any additive gave a scar diameter of 0.58 mm. ZDDP without lamp black reduced the wear index to only 0.27 mm. However, when lampblack was added the wear index with ZDDP increased sharply to 0.64 mm, which is higher than even the base oil with lampblack, but without ZDDP (0.43 mm). When molybdenum bis(di-n-dodecyl dithiocarbamate) was used in combination with ZDDP the wear index dropped significantly down to 0.31 mm. These results are surprising because in the absence of ZDDP, molybdenum bis(di-n-dodecyl dithiocarbamate) did not decrease wear and in fact increased wear slightly from 0.43 to 0.52 mm.

Results with molybdenum bis(di-2-ethylhexyl dithiocarbamate) were similar giving a scar of 0.30 mm in the presence of ZDDP and carbon soot.

Further 4-ball wear tests were carried out in a fully formulated commercial SE engine crankcase oil containing ZDDP, a calcium sulfonate detergent and an ashless dispersant. The following results were obtained:

| | Scar dia (mm) |
|---|---|
| 1. Commercial oil | 0.45 |
| 2. Commercial oil + 2% lampblack | 0.96 |
| 3. Commercial oil + 2% lampblack + 0.1% Ex. 2 additive | 0.40 |
| 4. Commercial oil + 2% lampblack + 1.0% Ex. 2 additive | 0.37 |
| 5. Commercial oil + 2% lampblack + 1.0% Ex. 1 additive | 0.38 |

As the above results show, the addition of lampblack to a commercial SE oil caused the scar diameter to double from 0.45 to 0.96 mm. Addition of 0.1 wt % of molybdenum bis[di(2-ethylhexyl)dithiocarbamate] reduced the scar diameter to 0.40 mm which is less than the original commercial oil without lampblack.

As mentioned earlier, the present additives are very effective in improving the friction properties of lubricating oils and greases. Thus, a further embodiment of the invention is a lubricating oil containing a friction reducing amount of a molybdenum bis(dialkyldithiocarbamate). Friction reducing amounts of about 0.05–3 wt % are useful. The molybdenum bis(dialkyldithiocarbamate) additives made are the same as previously described.

Tests were carried out which demonstrate the friction reducing properties of the present additives. Initially, friction tests were conducted. These tests were made using a bench apparatus in which a steel annulus and a steel plate were pressed against each other under 229 psi load. The steel annulus was rotated at 40 lineal ft/min and the torque required to start (static friction) and to maintain rotation (kinetic friction) was measured. The rubbing interface of the annulus and steel plate was lubricated with the test lubricating oil.

The base motor oil used in the test was formulated using neutral mineral oil. The base formulation included a commerical ashless dispersant (i.e. polyisobutylsuccinimide of polyethylene polyamine), a zinc dialkyldithiophosphate, an overbased calcium alkylbenzene sulfonate (300 base number), a phenolic antioxidant and a commerical polyacrylate VI improver. Both static and kinetic coefficient of friction were measured for the base oil and the base oil containing various concentrations of molybdenum bis(dialkyl dithiocarbamate). The results are given in the following table in terms of percent reduction in friction compared to that of the same oil without the additive:

| Additive | Conc | Friction Reduction (%) Static | Kinetic |
|---|---|---|---|
| Ex. 1 | 1% | 0.5 | 16.2 |

These results show that the additives are especially effective in reducing friction under kinetic conditions after the surfaces are in motion.

Further tests were conducted to determine the friction reducing effect of the additives over a longer term. These were carried out using the standard 4-ball test procedure in which one ball is rotated against three fixed balls immersed in test lubricant. Instead of measuring the scar diameter on the three fixed balls as in the standard test, the torque required to revolve the rotating ball was measured as an index of friction. The test was conducted under 20 kg load at 1,000 rpm at 130° F. lubricant temperature. Torque measurements were made at the start of test and again after three hours. The oil used was the same formulated oil as in the previous friction test. Results at start of test and after three hours in terms of percent reduction in friction compared to the same oil without the additive after the same period of operation were as follows:

| | | Friction Reduction | |
|---|---|---|---|
| Additive | Conc | Initial | Final |
| Ex. 1 | 1% | 12.3 | 37.7 |

These tests show that the test additives are especially beneficial in reducing friction after an extended period of operation.

We claim:

1. A lubricating oil composition suitable for use in the crankcase of an internal combustion engine, said composition comprising a major amount of mineral oil and a minor wear and friction reducing amount of an oil soluble molybdenum bis(dialkyldithiocarbamate).

2. A lubricating oil composition of claim 1 wherein the alkyl groups of said dialkyldithiocarbamate contain about 4–20 carbon atoms.

3. A lubricating oil composition of claim 2 wherein said dialkyldithiocarbamate is molybdenum bis(-didodecyldithiocarbamate).

4. A lubricating oil composition of claim 2 wherein said dialkyldithiocarbamate is molybdenum bis[di(2-ethylhexyl)dithiocarbamate].

5. A lubricating oil composition of claim 1 containing an antioxidant amount of an oil soluble zinc dihydrocarbyldithiophosphate which tends to increase engine wear due to blow-by carbon soot in diesel engines and a wear inhibiting amount of an oil soluble molybdenum bis(dialkyldithiocarbamate) which functions to counteract increased engine wear due to said zinc dihydrocarbyldithiophosphate and carbon soot.

6. A lubricating oil composition of claim 5 wherein the alkyl groups of said dialkyldithiocarbamate contain about 4–20 carbon atoms.

7. A lubricating oil composition of claim 6 wherein said molybdenum bis(dialkyldithiocarbamate) is molybdenum bis(didodecyldithiocarbamate).

8. A lubricating oil composition of claim 6 wherein said molybdenum bis(dialkyldithiocarbamate) is molybdenum bis[di(2-ethylhexyl)dithiocarbamate].

9. A lubricating oil composition of claim 6 wherein said zinc dihydrocarbyl dithiophosphate is a zinc dialkyldithiophosphate wherein the alkyl groups contain about 3–20 carbon atoms.

10. A lubricating oil composition of claim 9 wherein the alkyl groups in said zinc dialkyldithiophosphate are a mixture of isobutyl and amyl alkyl groups.

11. A lubricating oil composition of claim 9 wherein the alkyl groups in said zinc dialkyldithiophosphate are 2-ethylhexyl groups.

12. A lubricating oil composition of claims 10 or 11 wherein said molybdenum bis dialkyldithiocarbamate is molybdenum bis(didodecyldithiocarbamate).

13. A lubricating oil composition of claims 10 or 11 wherein said molybdenum bis(dialkyldithiocarbamate) is molybdenum bis[di(2-ethyhexyl)dithiocarbamate].

* * * * *